US009510121B2

(12) United States Patent
Xu et al.

(10) Patent No.: US 9,510,121 B2
(45) Date of Patent: Nov. 29, 2016

(54) TRANSDUCER AND METHOD OF CONTROLLING THE SAME

(71) Applicant: Agency for Science, Technology and Research, Singapore (SG)

(72) Inventors: Jinghui Xu, Singapore (SG); Julius Ming Lin Tsai, Singapore (SG)

(73) Assignee: Agency for Science, Technology and Research, Singapore (SG)

( * ) Notice: Subject to any disclaimer, the term of this patent is extended or adjusted under 35 U.S.C. 154(b) by 0 days.

(21) Appl. No.: 14/442,800

(22) PCT Filed: Dec. 6, 2013

(86) PCT No.: PCT/SG2013/000517
§ 371 (c)(1),
(2) Date: May 14, 2015

(87) PCT Pub. No.: WO2014/088517
PCT Pub. Date: Jun. 12, 2014

(65) Prior Publication Data

US 2015/0304777 A1 Oct. 22, 2015

(30) Foreign Application Priority Data

Dec. 6, 2012 (SG) ..... 201208975

(51) Int. Cl.
*H04R 7/04* (2006.01)
*H04R 29/00* (2006.01)
(Continued)

(52) U.S. Cl.
CPC ..... *H04R 29/004* (2013.01); *H04R 1/04* (2013.01); *H04R 1/326* (2013.01); *H04R 3/00* (2013.01);
(Continued)

(58) Field of Classification Search
CPC ..... H04R 7/04; H04R 1/00; H04R 29/004; H04R 2201/003
USPC ..... 73/602, 24.01, 579; 257/416; 381/58, 381/92, 172, 355, 365, 313, 326, 376; 438/113; 600/301, 25; 29/594; 310/317
See application file for complete search history.

(56) References Cited

U.S. PATENT DOCUMENTS 6,031,922 A * 2/2000 Tibbetts ..... H04R 1/38 381/313
6,629,464 B2 * 10/2003 Suh ..... B23K 26/0069 356/318
(Continued)

OTHER PUBLICATIONS

Scheeper, et al., A New Measurement Microphone Based on MEMS Technology, 12 Journal of Microelectomechanical Systems, 880 (2003).
(Continued)

*Primary Examiner* — Gerald Gauthier
(74) *Attorney, Agent, or Firm* — K. David Crockett, Esq.; Niky Economy Syrengelas, Esq.; Crockett & Crockett, PC

(57) ABSTRACT

According to embodiments of the present invention, a transducer is provided. The transducer includes a substrate, and a diaphragm suspended from the substrate, wherein the diaphragm is displaceable in response to an acoustic signal impinging on the diaphragm, wherein the transducer is configured, in a first mode of operation, to determine a direction of the acoustic signal based on a first displacement of the diaphragm in the first mode of operation, and to decide to accept or reject the acoustic signal based on at least one predetermined parameter and the determined direction of the acoustic signal, and in a second mode of operation, to sense the acoustic signal based on a second displacement of the diaphragm in the second mode of operation if the acoustic signal is accepted in the first mode of operation.

18 Claims, 13 Drawing Sheets

(51) Int. Cl.

| | |
|---|---|
| ***H04R 1/00*** | (2006.01) |
| ***H04R 1/04*** | (2006.01) |
| ***H04R 1/32*** | (2006.01) |
| *H04R 3/00* | (2006.01) |
| *H04R 19/00* | (2006.01) |
| *H04R 31/00* | (2006.01) |

(52) U.S. Cl.
CPC ..... *H04R 3/005* (2013.01); *H04R 19/005* (2013.01); *H04R 31/003* (2013.01); *H04R 2201/003* (2013.01); *H04R 2499/11* (2013.01)

(56) References Cited

U.S. PATENT DOCUMENTS 6,768,804 B1 * 7/2004 Isvan ..... H04R 1/083 181/20
6,798,890 B2 * 9/2004 Killion ..... H04R 1/083 381/313
7,146,014 B2 * 12/2006 Hannah ..... H04R 3/00 367/123
7,214,179 B2 * 5/2007 Miller, III ..... H04R 25/604 181/175
7,775,964 B2 * 8/2010 Miller, III ..... H04R 25/606 600/25
7,826,629 B2 * 11/2010 Miles ..... H04R 23/006 250/237 G
7,832,080 B2 * 11/2010 Killion ..... H04R 1/38 257/704
7,840,020 B1 * 11/2010 Miller, III ..... H04R 25/604 381/326
7,881,486 B1 * 2/2011 Killion ..... H04R 25/402 381/313
7,903,835 B2 3/2011 Miles
8,043,897 B2 * 10/2011 Lee ..... B81B 7/0061 257/416
8,213,661 B2 * 7/2012 Hinke ..... H04R 19/04 381/174
8,374,371 B2 * 2/2013 Miles ..... H04R 23/006 381/355
8,391,517 B2 * 3/2013 Avenson ..... H04R 23/008 381/172
8,934,640 B2 * 1/2015 Goodwin ..... H04R 3/005 381/92
8,989,422 B2 * 3/2015 Tanaka ..... H04R 19/005 381/175
2003/0125959 A1 7/2003 Palmquist
2009/0129621 A1 * 5/2009 Izuchi ..... H04M 1/03 381/365
2010/0278372 A1 11/2010 Zhang
2011/0299701 A1 12/2011 Karunasiri et al.
2012/0091546 A1 * 4/2012 Langereis ..... B81B 3/0072 257/416
2013/0172690 A1 * 7/2013 Arne ..... A61M 15/009 600/301
2015/0304777 A1 * 10/2015 Xu ..... H04R 1/326 381/58

OTHER PUBLICATIONS

Leinenbach, et al., A New Capacitive Type Mems Microphone, IEEE MEMS, 659 (IEEE 2010).
Kasai, et al., Novel Concept for a Mems Microphone with Dual Channels for an Ultrawide Dynamic Range, IEEE MEMS, 605 (IEEE 2011).
Miles, et al., A Low-Noise Differential Microphone Inspired by the Ears of the Parasitoid Fly Ormia Ochracea, 125 Journal Acoustical Society of America, 2013 (2013).
Chen, et al., Physical Analysis of a Biomimetic Microphone with a Central-Supported (C-S) Circular Diaphragm for Sound Source Localization, 12 IEEE Sensors Journal, 1504 (IEEE 2012).
Qu, et al., Analysis of Active Damping of a Silicon Microphone Using a Linear Controller, 2008 American Control Conference, 3767 (2008).
Zhuang, et al., Vapor-Phase Self-Assembled Monolayers for Anti-Stiction Applications in MEMS, 16 Journal of Microelectromechanical Systems, 1451 (2007).

* cited by examiner

800

802

TRANSDUCER AND METHOD OF CONTROLLING THE SAME

CROSS-REFERENCE TO RELATED APPLICATION

This application claims the benefit of priority of Singapore patent application No. 201208975-1, filed 6 Dec. 2012, the content of it being hereby incorporated by reference in its entirety for all purposes.

TECHNICAL FIELD

Various embodiments relate to a transducer and a method of controlling a transducer.

BACKGROUND

A microphone is a listening sensor which converts a sound signal to an electrical signal. The MEMS (Microelectromechanical systems) microphone market has been increasing since the last five years due to the successful applications of MEMS microphones in consumer electronics such as mobile phones, personal computers (PCs) and laptops, digital cameras, etc.

There are mainly two kinds of MEMS microphones; one being a parallel plate capacitor based microphone, which listens to the input sound signal and works in an Omni mode or its mechanical out of plane motion mode. As the mainstream MEMS microphones in the consumer electronics market, this type of microphones can listen to the input sound signal very well. However, the microphone listens to all sound signals applied at its diaphragm, including those signals that are undesired, such as background noise caused by wind or traffic around the microphone. In addition, this type of microphones suffers from a stiction (static friction) issue because of its small electrostatic gap (2 μm~4 μm) between the diaphragm and the back plate, a large diaphragm radius (usually >500 μm) and a small diaphragm thickness (usually <2 μm). An anti-stiction coating, e.g. a self assembled monolayer (SAM), etc., can be used to solve this stiction issue, but it will add to the costs of the microphones.

The other type of microphone is a bio-inspired microphone, which usually is used for sound source localization and works in a directional mode or its mechanical rocking mode. One example is a comb finger based directional microphone, which utilizes an optical measurement method to realize low noise differential detection and sound source localization. Another example is a centrally-supported circular diaphragm based microphone for large sensitivity and exact sound source localization.

Both types of microphones have a common point in that they only work in one mode: the Omni mode or the directional mode, meaning that the microphones either listen to the sound (with no directivity) or judge the direction of the sound source.

SUMMARY

According to an embodiment, a transducer is provided. The transducer may include a substrate, and a diaphragm suspended from the substrate, wherein the diaphragm is displaceable in response to an acoustic signal impinging on the diaphragm, wherein the transducer is configured, in a first mode of operation, to determine a direction of the acoustic signal based on a first displacement of the diaphragm in the first mode of operation, and to decide to accept or reject the acoustic signal based on at least one predetermined parameter and the determined direction of the acoustic signal, and in a second mode of operation, to sense the acoustic signal based on a second displacement of the diaphragm in the second mode of operation if the acoustic signal is accepted in the first mode of operation.

According to an embodiment, a method of controlling a transducer is provided. The method may include receiving an acoustic signal impinging on a diaphragm of a transducer, the diaphragm being suspended from a substrate of the transducer and being displaceable in response to the acoustic signal, determining a direction of the acoustic signal based on a first displacement of the diaphragm in a first mode of operation of the transducer, deciding to accept or reject the acoustic signal based on at least one predetermined parameter and the determined direction of the acoustic signal, and sensing the acoustic signal based on a second displacement of the diaphragm in a second mode of operation of the transducer if the acoustic signal is accepted.

BRIEF DESCRIPTION OF THE DRAWINGS

In the drawings, like reference characters generally refer to like parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

Figure 1A:
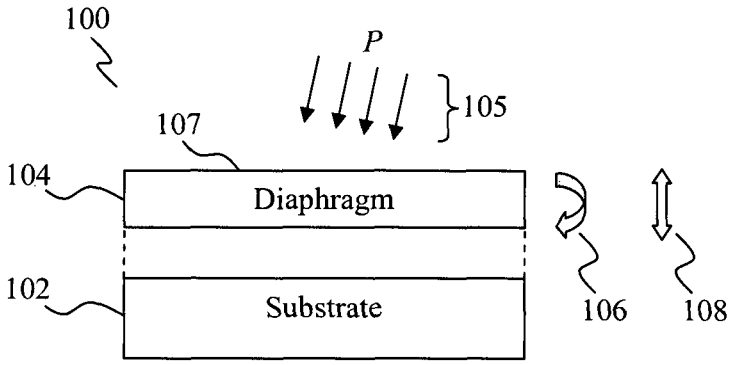
FIG. 1A shows a schematic cross sectional view of a transducer, according to various embodiments.

The following detailed description refers to the accompanying drawings that show, by way of illustration, specific details and embodiments in which the invention may be practiced. These embodiments are described in sufficient detail to enable those skilled in the art to practice the invention. Other embodiments may be utilized and structural, logical, and electrical changes may be made without departing from the scope of the invention. The various embodiments are not necessarily mutually exclusive, as some embodiments can be combined with one or more other embodiments to form new embodiments.

Embodiments described in the context of one of the methods or devices are analogously valid for the other method or device. Similarly, embodiments described in the context of a method are analogously valid for a device, and vice versa.

Features that are described in the context of an embodiment may correspondingly be applicable to the same or similar features in the other embodiments. Features that are described in the context of an embodiment may correspondingly be applicable to the other embodiments, even if not explicitly described in these other embodiments.

Furthermore, additions and/or combinations and/or alternatives as described for a feature in the context of an embodiment may correspondingly be applicable to the same or similar feature in the other embodiments.

In the context of various embodiments, the articles "a", "an" and "the" as used with regard to a feature or element includes a reference to one or more of the features or elements.

In the context of various embodiments, the phrase "at least substantially" may include "exactly" and a reasonable variance.

In the context of various embodiments, the term "about" or "approximately" as applied to a numeric value encompasses the exact value and a reasonable variance.

As used herein, the term "and/or" includes any and all combinations of one or more of the associated listed items.

As used herein, the phrase of the form of "at least one of A or B" may include A or B or both A and B. Correspondingly, the phrase of the form of "at least one of A or B or C", or including further listed items, may include any and all combinations of one or more of the associated listed items.

Various embodiments may relate to a microphone, for example a MEMS (Microelectromechanical systems) microphone, for example an Omni and directional dual mode microphone.

Various embodiments may provide a dual mode microphone, e.g. a dual mode capacitive MEMS microphone, and its related working model. The dual mode microphone may realize Omni and directional modes using the same structure of the microphone. The microphone structure may include one or more supported springs, a diaphragm and one or more vertical combs.

In various embodiments, the diaphragm may be a middle (or centrally) suspended diaphragm, and may have a rocking motion and an out of plane motion as the first two vibration modes, which may be physically related to the directional mode and the Omni mode, respectively, of the microphone. The directional mode may be used to judge the direction of the sound signal, where it may then be decided whether to reject or accept the sound signal according to its directivity pattern and/or a pre-defined threshold. The Omni mode may be used to sense the sound signal accepted by the directional mode.

The microphone of various embodiments may firstly judge the direction of the input sound signal by its directional or judging mode and may decide to accept or reject the input sound signal according to a directivity pattern of the microphone and/or a pre-defined threshold, and then may sense the accepted sound signal by its Omni mode. Therefore, by having dual working modes, the microphone may reject the unwanted (undesired) sound and may sense the wanted (desired) sound.

The selective sensing of the dual mode microphone of various embodiments may improve the sound or call quality significantly and may decrease the interference by any unwanted or undesired sound signal. In contrast, conventional microphones either listen to the sound or judge the direction of the sound source but they never firstly judge the direction of the sound, and then selectively listen to those sounds that a user wants, as enabled by the microphone of various embodiments.

In various embodiments, a type of vertical comb structure may be used to realize both the directional (or judging) mode and the Omni (or sensing) mode, so as to achieve dual modes. The vertical comb structure may be used to reject unwanted sound signals and sense the wanted sound signals according to a directivity pattern of the microphone and/or a pre-defined threshold. As a result of the use of the vertical comb structure as the sensing structure, a back plate, which is a critical structure in conventional parallel plate capacitor based MEMS microphones to form a capacitor with the diaphragm, may not be necessary in the microphone of various embodiments. The back plate free design of various embodiments may significantly simplify the fabrication process, and may eliminate directly the stiction issue (i.e. stiction free) associated with conventional parallel plate capacitor based microphones, thus improving the yield and reducing the costs of the microphones of various embodiments. Accordingly, the microphone of various embodiments may have a vertical comb structure and a back plate free design.

Compared to a conventional single mode microphone, various embodiments provide a dual mode microphone with its related working model.

Compared to a conventional parallel plate capacitor based microphone, the microphone of various embodiments utilizes one or more vertical comb structures to reject an unwanted sound signal, which may have a large deviation from a normal axis of a diaphragm of the microphone, and may sense a wanted sound signal.

Compared to a conventional parallel plate capacitor based microphone, the microphone of various embodiments utilizes a back plate free design. Thus, there may be no stiction issue. Further, a higher process yield may be achieved.

Compared to a conventional single mode differential microphone based on a common comb structure, the microphone of various embodiments utilizes one or more vertical comb structures to realize a dual mode working.

It should be appreciated that one or more of the features or principles employed in the transducer of various embodiments may be used for a hydrophone design.

FIG. 1A shows a schematic cross sectional view of a transducer 100, according to various embodiments. The transducer 100 includes a substrate 102, a diaphragm 104 suspended from the substrate 102, wherein the diaphragm 104 is displaceable in response to an acoustic signal (P) 105 impinging on the diaphragm 104, wherein the transducer 100 is configured, in a first mode of operation, to determine a direction of the acoustic signal 105 based on a first displacement of the diaphragm 104 in the first mode of operation, and to decide to accept or reject the acoustic signal 105 based on at least one predetermined parameter and the determined direction of the acoustic signal 105, and in a second mode of operation, to sense the acoustic signal 105 based on a second displacement of the diaphragm 104 in the second mode of operation if the acoustic signal 105 is accepted in the first mode of operation.

In other words, the transducer 100 may include a substrate 102 and a diaphragm 104 suspended from the substrate 102, which as a result may allow displacement of the diaphragm 104. The diaphragm 104 may include a membrane that may vibrate. When an acoustic signal (e.g. a sound or audio signal) 105 is incident on or strikes the diaphragm 104, the diaphragm 104 may be displaced as a result of pressure exerted by the acoustic signal 105. Therefore, the transducer 100 may be an acoustic device.

In a first mode of operation, a direction of the acoustic signal 105 may be determined by the transducer 100 based on the resulting displacement of the diaphragm 104 in the first mode of operation, so that the source of the acoustic signal 105 may be determined. As a non-limiting example, depending on the direction of the acoustic signal 105, the diaphragm 104 may be rotated, for example as represented by the arrow 106. However, it should be appreciated that the diaphragm 104 may be displaced in a reverse rotational direction, depending on the manner the acoustic signal 105 impinges on the diaphragm 104. Subsequently, the transducer 100 may make a decision as to whether to accept or reject the acoustic signal 105 based on at least one predetermined parameter and the determined direction of the acoustic signal 105. For example, if the determined direction of the acoustic signal 105 satisfies the condition imposed by the at least one predetermined parameter, the acoustic signal 105 may be accepted.

Where the acoustic signal 105 is accepted in the first mode of operation, subsequently in a second mode of operation, the acoustic signal 105 may be sensed by the transducer 100 based on the resulting displacement of the diaphragm 104 in the second mode of operation. This may mean that in the second mode of operation, information that is encoded in the acoustic signal 105 may be sensed or extracted. As a non-limiting example, the diaphragm 104 may be displaced in a direction at least substantially perpendicular to a surface 107 of the diaphragm 104, as represented by the double-headed arrow 108. For example, the diaphragm 104 may be displaced upwardly and/or downwardly in the second mode of operation.

Accordingly, as described above, based on the at least one predetermined parameter and the determined direction of an acoustic signal impinging on the diaphragm 104, an unwanted or undesired acoustic signal may be rejected while a wanted or desired acoustic signal may be sensed.

It should be appreciated that, in the first mode of operation, the diaphragm 104 may be displaced in a direction at least substantially perpendicular to the surface 107 of the diaphragm 104, e.g. a downward motion, in response to an acoustic signal impinging on the diaphragm 104 at least substantially perpendicular to the surface 107.

In the context of various embodiments, the first mode of operation may be a directional mode (or judging mode) of the transducer 100.

In the context of various embodiments, the second mode of operation may be an Omni mode (or sensing mode) of the transducer 100.

In the context of various embodiments, the first and second mode of operations may be related to the vibration modes of the diaphragm 104. For example, the vibration modes of the diaphragm 104 may include a rocking mode that may be related to the first mode of operation, and an out-of-plane mode that may be related to the second mode of operation.

In, the context of various embodiments, the first displacement of the diaphragm 104 and the second displacement of the diaphragm 104 may be different motions.

In various embodiments, the first displacement of the diaphragm 104 may be or may include a pivotal displacement, e.g. a rotational motion or a tilting motion. This may mean that opposite sides or opposite end regions of the diaphragm 104 may be displaced in opposite directions. For example, one side of the diaphragm 104 may be displaced upwardly while the opposite side of the diaphragm 104 may be displaced downwardly.

In various embodiments, the second displacement of the diaphragm 104 may be a linear displacement, where the diaphragm 104 may be displaced in a single direction or bi-directionally. For example, the diaphragm 104 may be displaced in an out-of-plane motion, e.g. in a vertical or up-down motion. In various embodiments, in the second mode of operation, the entire diaphragm 104 may be displaced.

In the context of various embodiments, in the first mode of operation, the diaphragm 104 may have a resonant frequency of about 5 kHz or less (i.e. ≤5 kHz), e.g. ≤3 kHz, ≤2 kHz or ≤1 kHz. As non-limiting examples, the diaphragm 104 may have a resonant frequency of between about 100 Hz and about 5 kHz, e.g. between about 100 Hz and about 3 kHz, between about 100 Hz and about 1 kHz, between about 500 Hz and about 5 kHz, between about 1 kHz and about 5 kHz, or between about 1 kHz and about 3 kHz, e.g. about 800 Hz, about 1 kHz, about 1.5 kHz, about 3 kHz or about 5 kHz.

In the context of various embodiments, in the second mode of operation, the diaphragm 104 may have a resonant frequency of about 10 kHz or more (i.e. ≥10 kHz), e.g. ≥20 kHz, ≥30 kHz, or ≥50 kHz. As non-limiting examples, the diaphragm 104 may have a resonant frequency of between about 10 kHz and about 100 kHz, e.g. between about 10 kHz and about 50 kHz, between about 10 Hz and about 30 kHz, between about 30 kHz and about 100 kHz, between about 30 kHz and about 50 kHz, or between about 50 kHz and about 100 kHz, e.g. about 15 kHz, about 22 kHz, about 30 kHz or about 50 kHz.

In various embodiments, the transducer 100 may further include at least one sensing element configured to determine the first displacement and the second displacement of the diaphragm 104.

In various embodiments, the at least one sensing element may include a pair of electrodes movable relative to each other. The pair of electrodes may define a capacitor and as the pair of electrodes are moved or displaced relative to each other, the associated capacitance may be changed. In this way, the at least one sensing element may be a capacitive sensing element.

In various embodiments, an electrode of the pair of electrodes may be connected or coupled to the diaphragm 104. The electrode that is connected to the diaphragm 104 may be a movable electrode as it may be displaced relative to the other electrode of the pair of electrodes as a result of the displacement of the diaphragm 104, while the other electrode may be a stationary or fixed electrode.

In various embodiments, each electrode of the pair of electrodes may include a plurality of fingers, and a height of each finger of the electrode that may be connected to the diaphragm 104 may be less than a height of each finger of the other electrode of the pair of electrodes. This may mean that each electrode may have a comb structure.

In various embodiments, each electrode of the pair of electrodes may include a plurality of fingers. This may mean that each electrode may have a comb structure. The fingers of respective electrodes of the pair of electrodes may be movable relative to each other, for example vertically movable relative to each other. In this way, the pair of electrodes may define a vertical comb structure, which may be used to reject any unwanted sound signal and sense any wanted sound signal.

In various embodiments, the pair of electrodes of the at least one sensing element may be arranged in an interdigitated pattern. This may mean that respective fingers of the pair of electrodes may be alternately arranged.

In various embodiments, at least one first sensing element may be arranged on a first side of the diaphragm 104, and at least one second sensing element may be arranged on a second side of the diaphragm 104 opposite to the first side. It should be appreciated that at least one of the at least one first sensing element or the at least one second sensing element may be a capacitive sensing element, e.g. as described above.

In various embodiments, the transducer 100 may further include at least one resilient element (e.g. spring) coupled to the diaphragm 104 for suspending the diaphragm 104 from the substrate 102. The diaphragm 104 may be pivotally displaced about the at least one resilient element in the first mode of operation. This may mean that the at least one resilient element may act as a pivot or hinge for the diaphragm 104. In various embodiments, the at least one resilient element may be arranged to couple to the diaphragm 104 centrally, for example coupled to the diaphragm 104 at a point along a central axis of the diaphragm 104. In various embodiments, the at least one sensing element may be arranged on one side, of the at least one resilient element. In embodiments having at least one first sensing element and at least one second sensing element, the at least one first sensing element and the at least one second sensing element may be arranged on opposite sides of the at least one resilient element.

In various embodiments, the transducer 100 may include two resilient elements coupled to opposite sides of the diaphragm 104 for suspending the diaphragm 104 from the substrate 102.

In various embodiments, the transducer 100 may further include a processing circuit configured to perform at least one of determining the direction of the acoustic signal, deciding to accept or reject the acoustic signal, or sensing the acoustic signal. The processing circuit may include a comparator configured to receive at least one of two orthogonal components derived (or decomposed) from the acoustic signal 105, the comparator further configured to compare a magnitude of a component of the two orthogonal components or a ratio of magnitudes of the two orthogonal components against the at least one predetermined parameter so as to decide to accept or reject the acoustic signal 105. The two orthogonal components may be vector components. One component of the two orthogonal components may be parallel to the surface 107 of the diaphragm 104, defining a directional component, while the other component may be perpendicular to the surface 107, defining an Omni component.

In the context of various embodiments, the at least one predetermined parameter may include a directivity pattern of the transducer 100 and a predetermined angle of incidence threshold value for the acoustic signal 105. This may mean that a pre-defined threshold value related to an angle of incidence at which the acoustic signal 105 impinges on the diaphragm 104 may be used as a basis for accepting or rejecting the acoustic signal 105, e.g. an acoustic signal arriving within the predetermined angle of incidence threshold value may be accepted while other acoustic signals arriving from any other directions may be rejected.

In the context of various embodiments, the transducer 100 may further include an electrical interconnection, e.g. a metal pad, electrically coupled to the diaphragm 104. The transducer 100 may further include another electrical interconnection, e.g. a metal pad, electrically coupled to the at least one sensing element.

In the context of various embodiments, the transducer 100 may be a dual mode transducer (e.g. a dual mode microphone), for example a transducer capable of operating in a directional mode and an Omni mode. The transducer 100 may be a dual mode transducer realizing Omni and directional modes using the same structure (i.e. single structure) of the transducer 100.

In the context of various embodiments, the transducer 100 may be a microphone. The transducer 100 may be a dual mode capacitive MEMS (Microelectromechanical systems) microphone.

In the context of various embodiments, the transducer 100 may be free of a back plate or a back electrode for forming a capacitor with the diaphragm 104, which otherwise is required in conventional parallel plate capacitor based microphones.

Figure 1B:
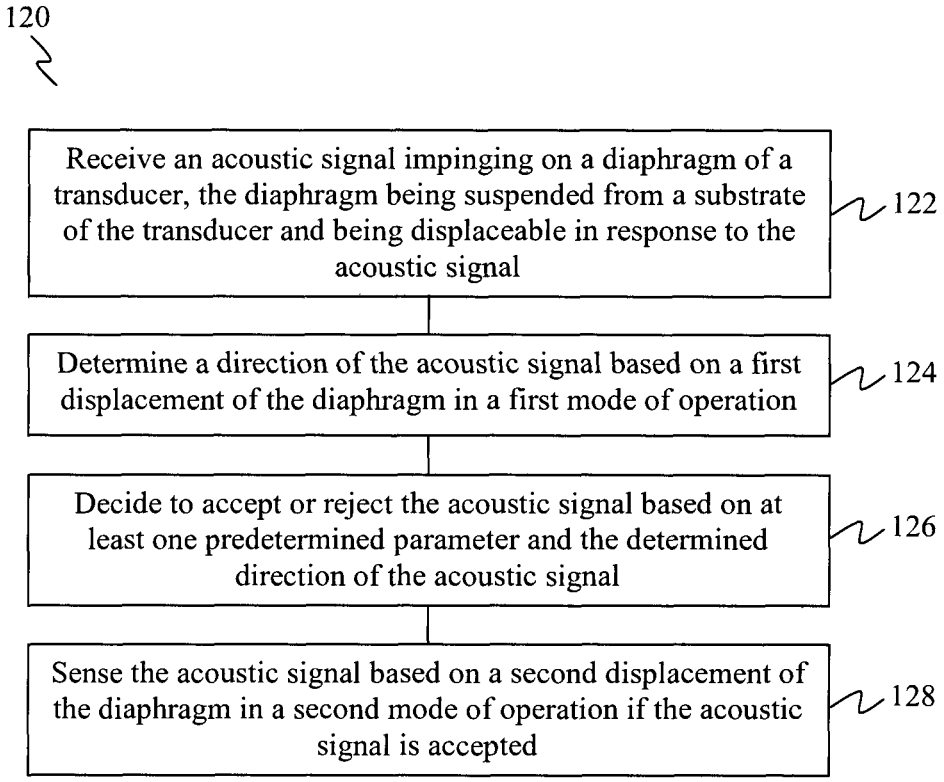
FIG. 1B shows a flow chart illustrating a method of controlling a transducer, according to various embodiments.

FIG. 1B shows a flow chart 120 illustrating a method of controlling a transducer, according to various embodiments.

At 122, an acoustic signal is received, the acoustic signal impinging on a diaphragm of a transducer, the diaphragm being suspended from a substrate of the transducer and being displaceable in response to the acoustic signal.

At 124, a direction of the acoustic signal is determined based on a first displacement of the diaphragm in a first mode of operation.

At 126, the acoustic signal is accepted or rejected based on at least one predetermined parameter and the determined direction of the acoustic signal.

At 128, the acoustic signal is sensed based on a second displacement of the diaphragm in a second mode of operation if the acoustic signal is accepted.

In various embodiments, at 126, for deciding to accept or reject the acoustic signal, two orthogonal components (e.g. vector components) may be derived or decomposed from the acoustic signal based on the determined direction of the acoustic signal, and a magnitude of a component of the two orthogonal components or a ratio of magnitudes of the two orthogonal components may be compared against the at least one predetermined parameter so as to decide to accept or reject the acoustic signal.

In various embodiments, the first displacement of the diaphragm may be or may include a pivotal displacement, e.g. a rotational motion or a tilting motion.

In the context of various embodiments, the at least one predetermined parameter may include a directivity pattern of the transducer and a predetermined angle of incidence threshold value for the acoustic signal.

Figure 2A:
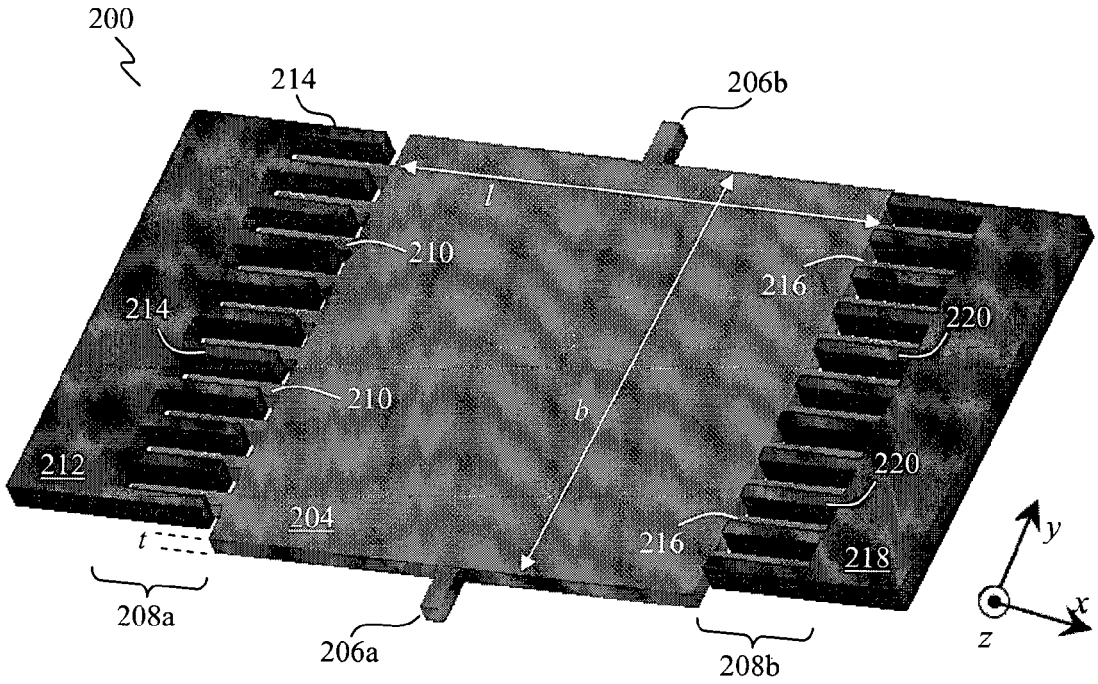
FIGS. 2A and 2B show a perspective view and a schematic cross sectional view of a microphone, respectively, according to various embodiments.
Figure 2B:
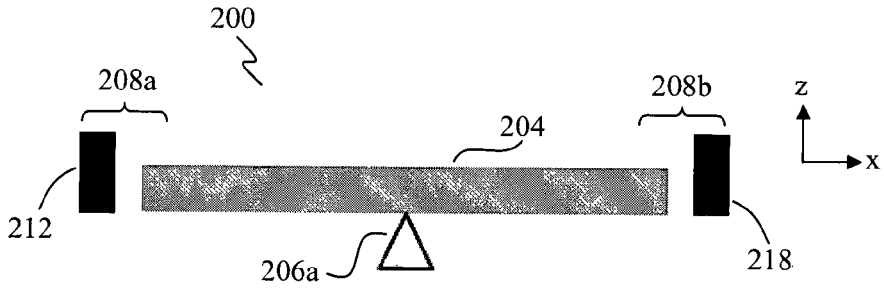

Various embodiments may provide a transducer, such as a microphone, for example a dual mode MEMS microphone. The performance of the microphone may be improved using vertical comb based sensing structures. FIGS. 2A and 2B show a perspective view (or 3D model) and a schematic cross sectional view of a microphone 200, respectively, according to various embodiments. The microphone 200 may include a middle or centrally suspended diaphragm 204, support springs 206*a*, 206*b*, and vertical comb structures 208*a*, 208*b*.

The diaphragm 204 may have a quadrilateral shape (e.g. rectangular or square), although other shapes may be suitable. The diaphragm 204 may have a length, l, a width, b and a thickness, t. The support springs 206*a*, 206*b* may be located at the middle of the diaphragm 204, for example along a central axis of the diaphragm 204, for suspending the diaphragm 204 from a substrate (not shown). The springs 206*a*, 206*b*, may facilitate movement or displacement of the diaphragm 204. In this way, the springs 206*a*, 206*b*, may act as anchors or pivots for the diaphragm 204. Therefore, the diaphragm 204 may be a movable structure. In FIG. 2B, the spring 206*a* is represented by a triangle below the diaphragm 204 to illustrate that the spring 206*a* acts as an anchor or hinge for supporting the diaphragm 204 to enable movement or displacement of the diaphragm 204 about the spring 206*a*.

The vertical comb structures 208*a*, 208*b* may act as sensing elements, in the form of capacitive sensing elements. The vertical comb structures 208*a*, 208*b* may be arranged towards opposite end regions of the diaphragm 204, on opposite sides of the springs 206*a*, 206*b*. Each comb structure 208*a*, 208*b* may include a pair of electrodes movable relative to each other, where each electrode may have a plurality of fingers. Each pair of electrodes may be arranged in an interdigitated pattern.

Using the comb structure 208*a* as a non-limiting example, a plurality of fingers, as represented by 210 for two fingers, as part of an electrode, may be coupled or connected to the diaphragm 204. The plurality of electrode fingers 210 may be movable as a result of the displacement of the diaphragm 204. Therefore, the plurality of electrode fingers 210 may form part of a movable electrode. The comb structure 208*a* may include a second electrode 212 having a plurality of fingers, as represented by 214 for two fingers. The second electrode 212 may be stationary and thus may form a fixed electrode. The plurality of electrode fingers 210, 214 may be arranged at least substantially parallel to each other to define capacitors. The plurality of fingers 210, 214 may be interdigitated, meaning that the plurality of fingers 210, 214 may be arranged alternately. Similarly, the comb structure 208*b* may include a movable electrode connected to the diaphragm 204, having a plurality of electrode fingers 216 and a fixed electrode 218 having a plurality of electrode fingers 220.

Figure 2C:
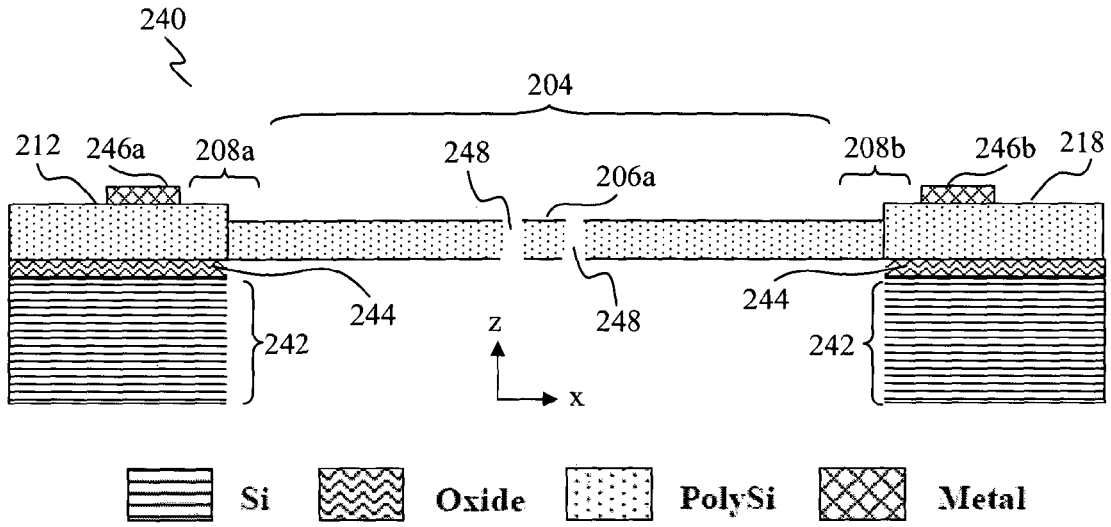
FIG. 2C shows a cross sectional view of a microphone, according to various embodiments.

FIG. 2C shows a cross sectional view of a microphone 240, according to various embodiments. The microphone 240 may include a substrate (e.g. a silicon (Si) substrate) 242, a dielectric layer (e.g. an oxide layer) 244, and a diaphragm 204 suspended from the substrate 242, via the spring 206*a*. The diaphragm 204, the springs 206*a*, 206*b* (not shown in FIG. 2C), the comb structures 208*a*, 208*b* and the electrodes 212, 218 may be made of polycrystalline silicon (poly-Si). The microphone 240 may further include a contact pad 246*a* on the electrode 212, and a contact pad 246*b* on the electrode 218. The contact pads 246*a*, 246*b* may be metal pads.

Figure 2D:
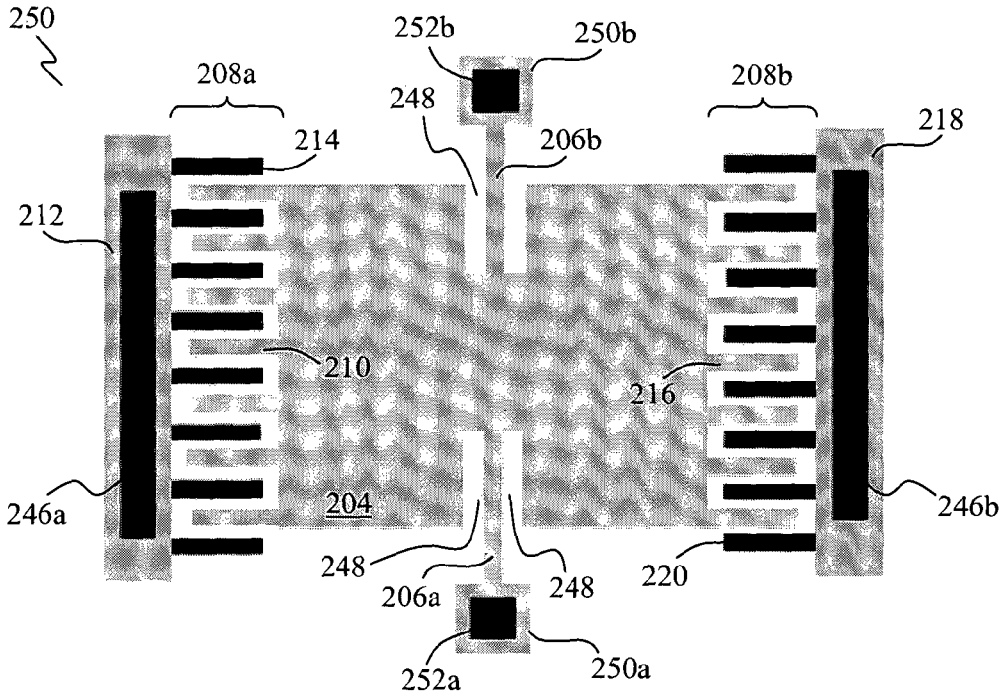
FIG. 2D shows a schematic top view of a microphone, according to various embodiments.

As may be observed in FIG. 2C, there may be gaps 248 between the spring 206*a* and the diaphragm 204. The gaps 248 may be provided in various embodiments for saving area of the microphone, for example as shown for the microphone 250 of FIG. 2D. This may reduce the materials used and therefore also reduce the cost. Like features or structures of the microphone 250 may be as described in the context of the microphones 200, 240. The microphone 250 further includes contact pads (e.g. metal pads) 246*a*, 246*b* electrically coupled to the electrodes 212, 218 respectively. The microphone 250 may further include anchors or supporting structures 250*a*, 250*b* coupled to the springs 206*a*, 206*b* respectively, with respective contact pads (e.g. metal pads) 252*a*, 252*b*. It should be appreciated that the working principle and the mode shape of the microphone 250 remain at least substantially the same as that for the microphones 200, 240, but the spring design for the microphone 250 may save some device area.

As shown in FIGS. 2A to 2C, the height of the fingers 210 may be less than the height of the fingers 214. Similarly, the fingers 216 may have a lower height than that of the fingers 220.

As shown in FIGS. 2A to 2C, the springs 206*a*, 206*b* may be located at the middle of the diaphragm 204, which may enable the first two vibration modes of the diaphragm 204 to be a rocking mode along or about the springs 206*a*, 206*b*, and a motion mode along the z-axis direction, respectively. In various embodiments, the resonant frequency of the rocking mode (equivalent to a directional mode) may be less than about 3 kHz so as to improve the sensitivity of the microphones 200, 240, while the resonant frequency of the motion mode (equivalent to an out of plane motion or Omni mode) may be larger than about 15 kHz so as to ensure a flat frequency response with as large a frequency range as possible. As a non-limiting example, the resonant frequencies of the rocking mode and the motion mode may be approximately 1 kHz and approximately 22 kHz respectively.

Figure 3A:
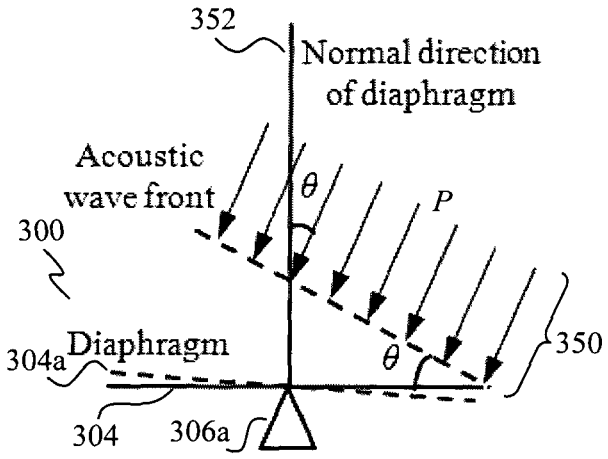
FIG. 3A shows a schematic of an acoustic wave front arriving at a diaphragm of a microphone, according to various embodiments.

FIG. 3A shows a schematic of an acoustic wave front (e.g. a plane sound wave), P, 350 arriving at a diaphragm 304 of a microphone 300, according to various embodiments, illustrating the judging mode response of the microphone 300 to a sound wave front 350 impinging on the diaphragm 304. As illustrated, when a sound signal, P, 350 with a deviation or incident angle, θ, relative to the normal direction (indicated as 352) of the diaphragm 304 arrives at the diaphragm 304, the arriving time of the sound wave front 350 may be different at different positions or points of the diaphragm 304. This may cause the middle suspended diaphragm 304 to rotate slightly along or about the support springs, one of which is indicated as the triangle 306*a*, which may act as pivots. Therefore, the diaphragm 304 may be rotated or pivotally displaced from its original or equilibrium orientation (indicated as the solid line 304) to a displaced orientation or position (indicated as the dashed line 304*a*). In this mode of operation, the microphone 300 works in a directional mode and may show a directivity pattern illustrated in FIG. 3C, which will be described later. It should be appreciated that where the sound wave front 350 impinges on the diaphragm at least substantially vertically to the diaphragm 304, e.g. $\theta \approx 0$, the arriving time of the sound wave front 350 may be at least substantially similar at different points of the diaphragm 304 and as a result, the diaphragm 304 may be displaced downwardly, in an out-of-plane motion.

Figure 3B:
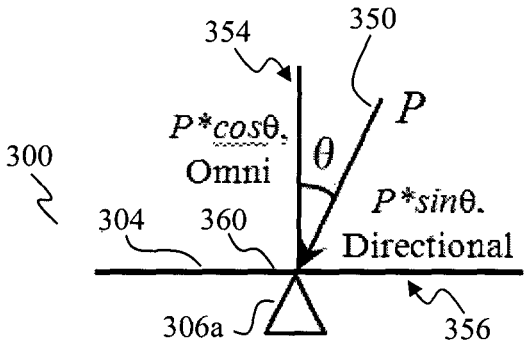
FIG. 3B shows a schematic of the components of an incident acoustic wave on a diaphragm of a microphone, according to various embodiments.

FIG. 3B shows a schematic of the components of an incident acoustic wave, P, 350 on a diaphragm 304 of a microphone 300, according to various embodiments. As illustrated, the input sound wave 350 may have two orthogonal components: an Omni component, P×cos θ, 354 which is perpendicular to the surface 360 of the diaphragm 304 impinged by the sound wave 350, and a directional component, P×sin θ, 356 which is parallel to the surface 360.

Figure 3C:
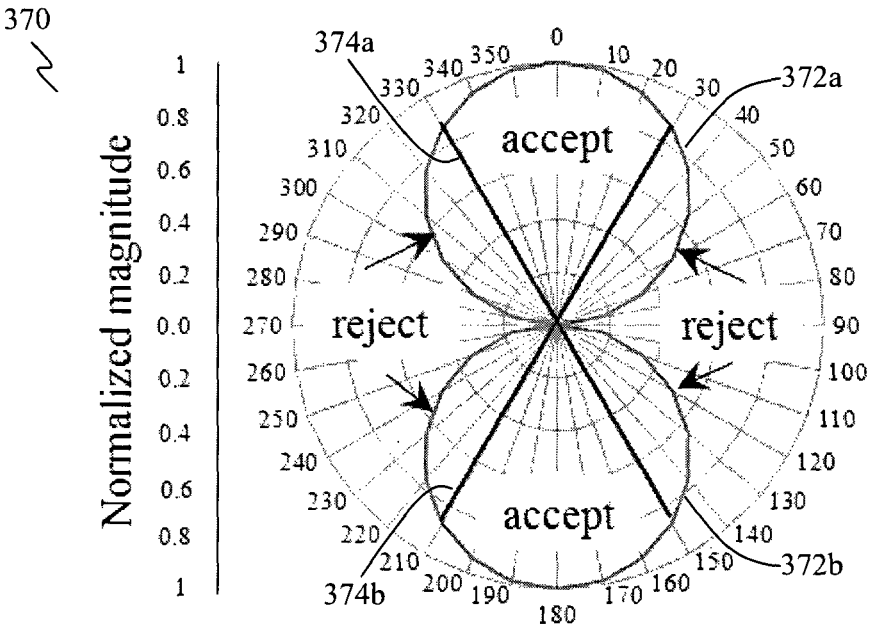
FIG. 3C shows a directivity pattern of a microphone, according to various embodiments.

FIG. 3C shows a directivity pattern 370 of a microphone in a judging or directional mode, according to various embodiments, illustrating the different normalized Omni component (P×cos θ) magnitudes for input sound signals impinging on a diaphragm of the microphone at different deviation angles, θ, ranging between 0 and 360° at intervals of 10°. The normalized Omni component magnitudes are illustrated by the two circles 372*a*, 372*b*, which collectively form a figure eight pattern. In various embodiments, a rule or requirement may be defined to decide which sound signals should be accepted and which ones should be rejected. As a non-limiting example, a predetermined threshold deviation angle of 30° may be set, meaning that sound signals with a deviation or incident angle equal to or less than 30° from the normal direction 352 (FIG. 3A) may be accepted, and all other sound signals may be rejected, as shown in FIG. 3C with the lines 374*a*, 374*b* indicating the cut off boundaries for the threshold deviation angle of 30°.

Figure 3D:
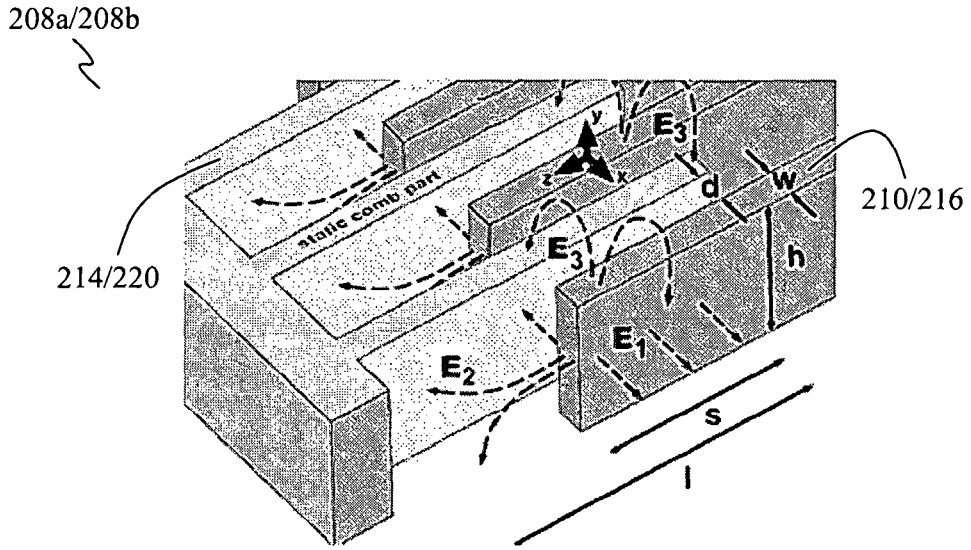
FIG. 3D shows a partial perspective view of a comb structure of a microphone, according to various embodiments.

In various embodiments, vertical comb structures may be used to realize the dual working mode of the microphones of various embodiments. Using the microphone 200 as a non-limiting example, the comb structures 208*a*, 208*b* may be employed to realise the directional mode and the Omni mode of the microphone 200. When the microphone 200 operates in the directional mode, the diaphragm 204 operates in a rocking mode such that the respective capacitances associated with the comb structures 208*a*, 208*b* may be biased in opposite directions as a result of a displacement of the diaphragm 204. For example, the capacitance associated with the vertical comb structure 208*a* may increase, and that of the vertical comb structure 208*b* may decrease, with fringe field considered, or vice versa. The differential change of the respective capacitances may be used to localize the direction of the input sound signals according to a directivity pattern of the microphone 200. The "fringe field" may be explained as follows by way of reference to FIG. 3D using the comb structure 208*a* or 208*b* as a non-limiting example. In FIG. 3D, three pairs of comb fingers 210, 214 or 216, 220 are illustrated with the parameters: finger length (l). finger overlap (s), finger width (w), finger-to-finger gap (d), and comb or finger height (h). Also illustrated in FIG. 3D are the electric fields, where only the field lines emanating from the movable comb parts or fingers 210 or 216 are shown. The electric fields may include en electric field ($E_1$) (i.e. internal electrical field) emanating from the sidewalls of the fingers 210 or 216, an electric field ($E_2$) (fringe field) emanating from the finger front faces, and an electric field ($E_3$) (fringe field) emanating from the upper and lower finger faces. Accordingly, the fringe field refers to the electric fields $E_2$ and $E_3$, i.e. $E_2$ $E_3$. Triad: Coordinate axes may be used for computations.

When the microphone 200 operates in the Omni mode, the diaphragm 204 operates in a motion mode such that the diaphragm 204 may move or be displaced up and down, in the z-axis direction. The displacement of the diaphragm 204 may cause a change in the respective capacitances associated with the vertical comb structures 208*a*, 208*b*, for example the respective capacitances may be increased or decreased. The capacitance fluctuation during the motion mode of the diaphragm 204 may be at a much larger level than the capacitance variation during the rocking mode of the diaphragm 204, and thus the input sound signal may be sensed.

As the vertical comb structures 208*a*, 208*b* are adopted as the sensing structures, a back plate, which is a critical structure in conventional parallel plate capacitor based MEMS microphones to form a capacitor with the diaphragm, is no longer necessary in the microphone 200. The back plate free design may significantly simplify the fabrication process, thus improving the yield and decreasing the costs of the microphone, and may eliminate directly the stiction issue present in conventional parallel plate capacitor based microphones.

Figure 4A:
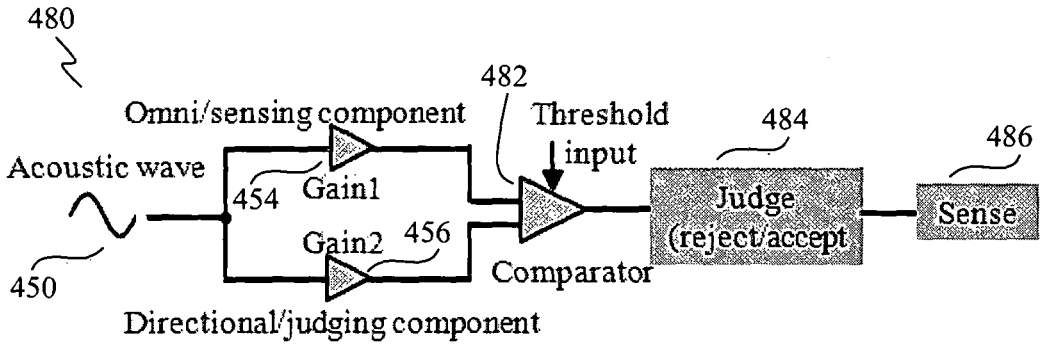
FIGS. 4A and 4B show respective working models of the dual mode microphone of various embodiments.
Figure 4B:
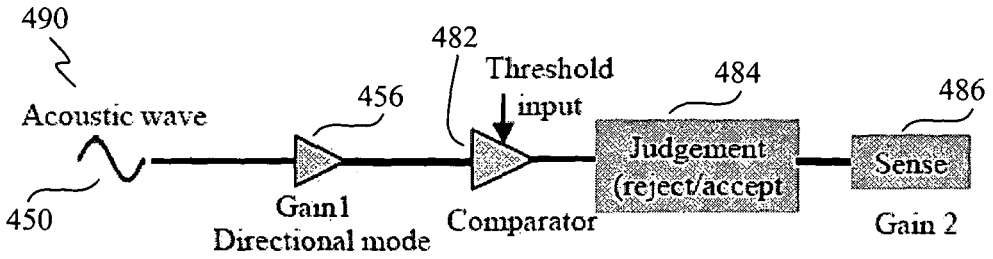

FIGS. 4A and 4B show respective working models of the dual mode microphone of various embodiments. As shown in FIG. 3B and described above, the input sound signal impinging on a microphone diaphragm may have an Omni component, P×cos θ, and a directional component, P×sin θ. For FIG. 4A illustrating a working model 480, based on an acoustic wave 450, an Omni or sensing component 454, which may be subjected to a gain (e.g. Gain 1), and a directional or judging component 456, which may be subjected to a gain (e.g. Gain 2), of the acoustic wave 450 may be provided as inputs to a comparator 482 and compared to a directivity pattern of the microphone (e.g. please refer to FIG. 3C) and an input threshold (e.g. a predetermined threshold deviation angle) provided to the comparator 482. Different comparison methods may be employed. As non-limiting examples, the Omni component 454, such as its magnitude, may be used for comparison, or the directional component 456, such as its magnitude, may be used for comparison, or a ratio of the Omni component 454 and the directional component 456, such as ratio of their respective magnitudes may be used for comparison. The comparator 482 may be part of a processing circuit of the microphone of various embodiments.

During the comparison, the input sound signals, e.g. 450, may be selectively accepted or rejected according to their associated deviation angles from the normal direction of the diaphragm, as represented by the block 484. The accepted sound signals may then be sensed by the Omni mode of the microphone, as represented by the block 486. In this way, the desired sound signal(s) may be accepted and the information encoded in the sound signal(s) may be sensed or retrieved.

For FIG. 4B illustrating a working model 490, a directional or judging component 456, which may be subjected to a gain (e.g. Gain 1), of an acoustic wave 450 may be provided as an input to a comparator 482 and compared to a directivity pattern of the microphone (e.g. FIG. 3C) and an input threshold (e.g. a predetermined threshold deviation angle) provided to the comparator 482. During the comparison, the input sound signals, e.g. 450, may be selectively accepted or rejected according to their associated deviation angles from the normal direction of the diaphragm, as represented by the block 484. The accepted sound signals may then be sensed by the Omni mode of the microphone, as represented by the block 486. The accepted sound signals may be subjected to a gain (e.g. Gain 2).

FIGS. 5A to 5L show, as cross-sectional views, various processing stages of a method for manufacturing a microphone, according to various embodiments, illustrating the process flow for a microphone integration fabrication. Six masks may be used in the manufacturing process.

Figure 5A:
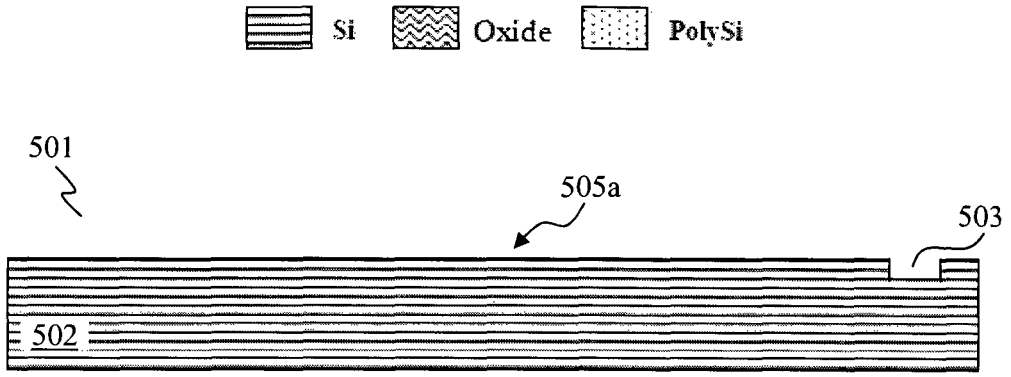
FIGS. 5A to 5L show, as cross-sectional views, various processing stages of a method for manufacturing a microphone, according to various embodiments.

Referring to FIG. 5A, a common wafer may first be provided. As a non-limiting example, a silicon (Si) substrate 502 may be used. An alignment mark (e.g. a recess) 503 may be formed by etching a portion of the substrate 502 on a front side 505*a* of the substrate 502, with the use of a mask (Mask 1) and a suitable etching process. As a result, a structure 501 may be obtained.

Figure 5B:
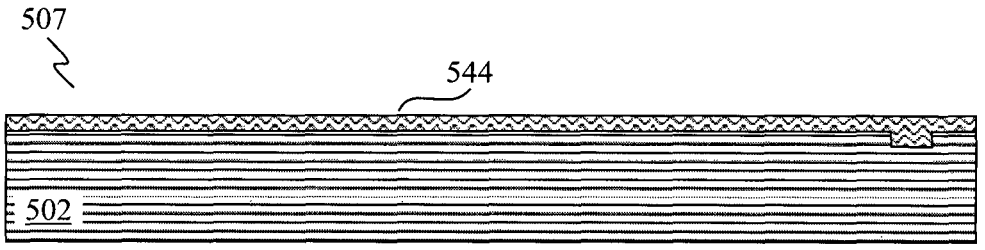

A layer of oxide (e.g. silicon oxide, $SiO_2$) 544 of approximately 2 μm may then be deposited on the substrate 502, as shown in FIG. 5B. As a non-limiting example, a chemical vapour deposition (CVD) process may be employed, using TEOS (tetraethylorthosilicate; $Si(OC_2H_5)_4$) as a source for depositing a 2 μm TEOS oxide layer as the oxide layer 544. As a result, as shown in FIG. 5B, a structure 507 may be obtained.

Figure 5C:
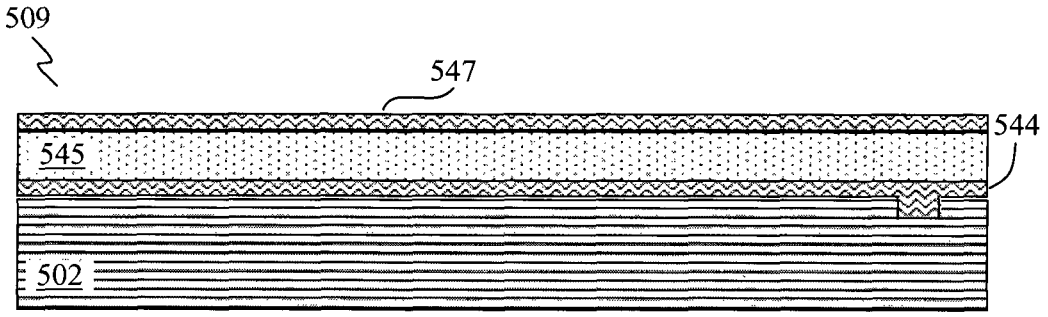

Referring to FIG. 5C, a layer 545 of about 3 μm of low stress polysilicon (poly-Si) may then be deposited over the oxide layer 544 by plasma-enhanced CVD (PECVD), followed by deposition of another oxide layer (e.g. silicon oxide, $SiO_2$) 547 on the front side 505*a* of the substrate 502. The oxide layer 547 may be a 1 μm TEOS oxide layer, formed using a similar process for forming the oxide layer 544. As a result, a structure 509 may be obtained.

Figure 5D:
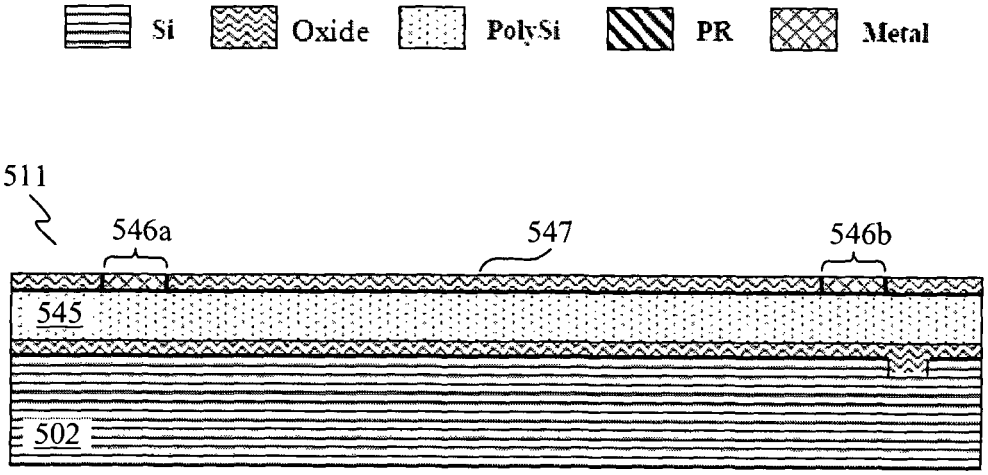

Patterning of the structure 509 may then be carried out for forming contact vias and metal pads. Referring to FIG. 5D, a second mask (Mask 2) may be used, together with etching and metal deposition, to form contact vias (not shown) and a third mask (Mask 3) may be used, together with etching and metal deposition, to form metal pads 546*a*, 546*b* through the oxide layer 547. As a result, a structure 511 may be obtained.

Figure 5E:
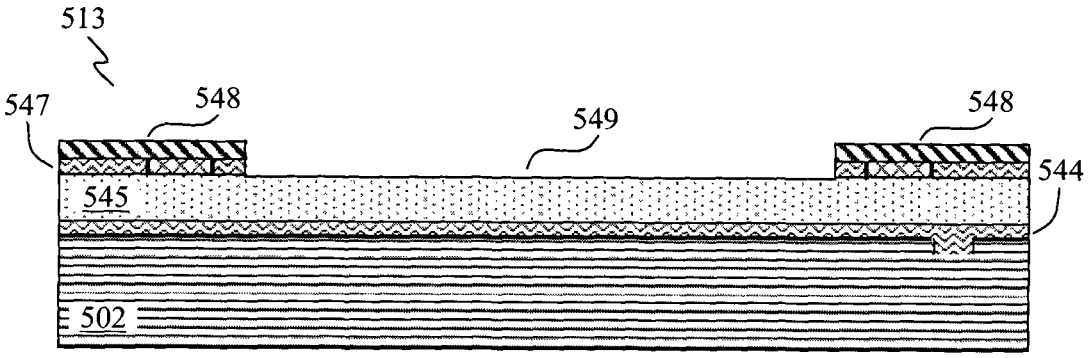

Referring to FIG. 5E, a 2 μm photoresist (PR) coating 548 may be deposited over the structure 511 and patterned so as to form a mask (Mask 4). The patterned PR coating 548 may expose the area of the structure 511 where etching may subsequently be performed for forming a suspended structure which may include a diaphragm, springs and vertical comb structures. A portion of the oxide layer 547 may then be etched, via the patterned PR coating 548, to form a recess 549. The oxide layer 547 may act as a hard mask for subsequent etching processes, for example when forming the suspended structure. As a result, a structure 513 may be obtained. The recess 549 may be centrally located in the structure 513, such that a central supported suspended structure or diaphragm may be subsequently formed.

Figure 5F:
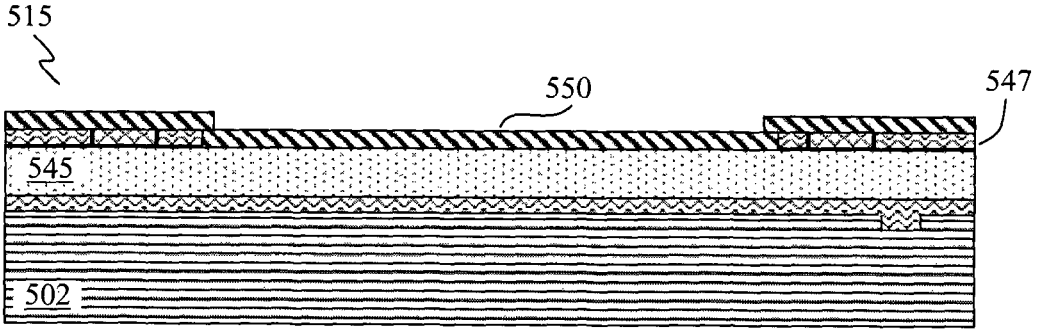

The patterned PR, coating 548 may then be stripped from the structure 513 and a 2 μm photoresist (PR) coating 550 may then be deposited over the oxide layer 547 and the metal pads 546*a*, 546*b* and within the recess 549, as shown in FIG. 5F. A structure 515 may be obtained.

Figure 5G:
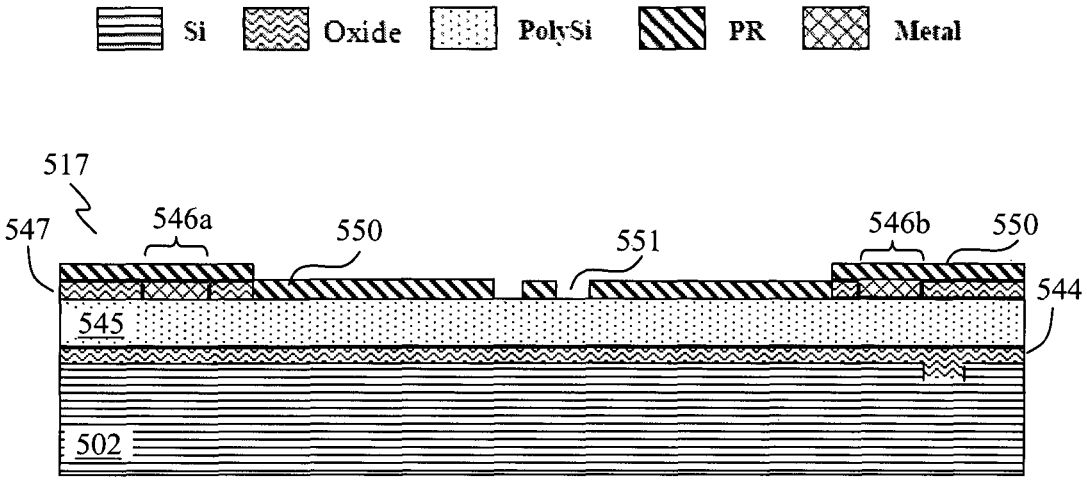
Figure 5H:
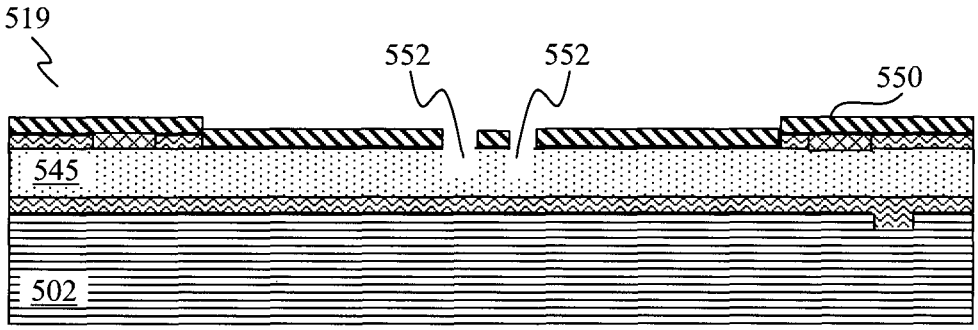

Referring to FIG. 5G, the PR coating 550 may be patterned so as to leave a number of recesses 551 formed through the PR coating 550 so as to form a mask (Mask 5). As a result, a structure 517 may be obtained. The recesses 551 may correspond to areas where the diaphragm and springs may be subsequently formed, e.g. by etching. While not clearly shown, recesses may also be formed in the structure 517 where vertical comb structures, including movable and fixed portions of the vertical comb structures, may be subsequently formed via etching.

A reactive ion etching (RIE) process may then be carried out to etch about 2 μm of the poly-Si layer 545 through the recesses 551. As a result, a structure 519 may be obtained, with recesses 552 formed about 2 μm into the poly-Si layer 545.

Figure 5I:
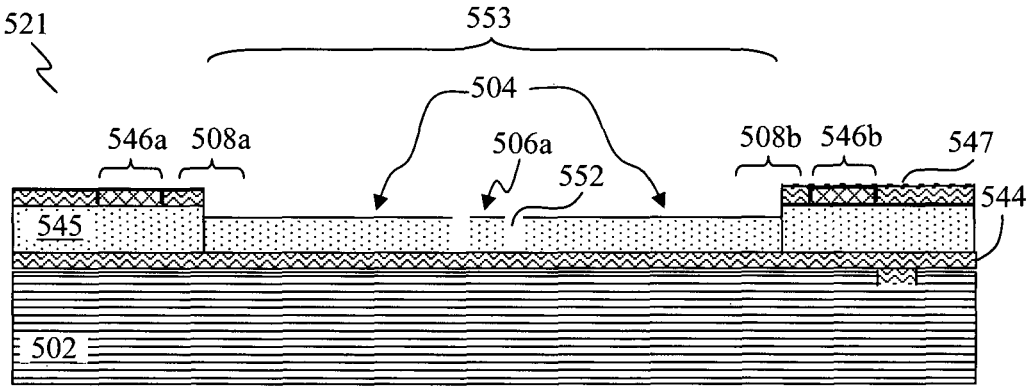

The patterned PR coating 550 may then be stripped from the structure 519 so as to expose the entire area where the suspended structure may be formed. A reactive ion etching (RIE) process may then be carried out to etch about 1 μm of the poly-Si layer 545 using the oxide layer 547 as the hard mask and stopping at the oxide layer 544, as shown in FIG. 5I. Therefore, portions of the poly-Si layer 545 corresponding to the diaphragm 504, springs (one spring indicated as 506*a*), and vertical comb structures 508*a*, 508*b* of a suspended structure 553 that is to be formed may be defined. As a result, a structure 521 may be obtained.

Figure 5J:
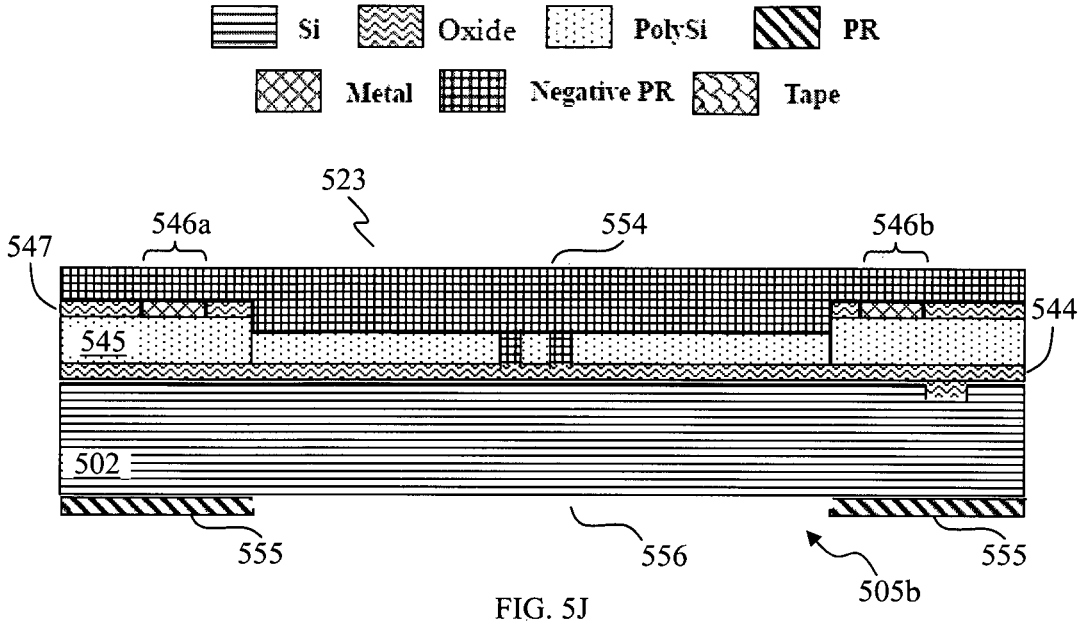

Referring to FIG. 5J, a 2 μm negative photoresist (PR) coating 554 may be deposited on the front side 505*a* and hard baked so as to protect the suspended structure 553. Backside grinding may then be carried out to grind the substrate 502 to about 400 μm. A 10 μm photoresist (PR) coating 555 may be deposited on the back side 505*b* of the substrate 502 and patterned to form a mask (Mask 6) so as to define a window or opening 556 for a subsequent deep reactive ion etching (DRIE) process to be carried out. As a result, a structure 523 may be obtained.

Figure 5K:
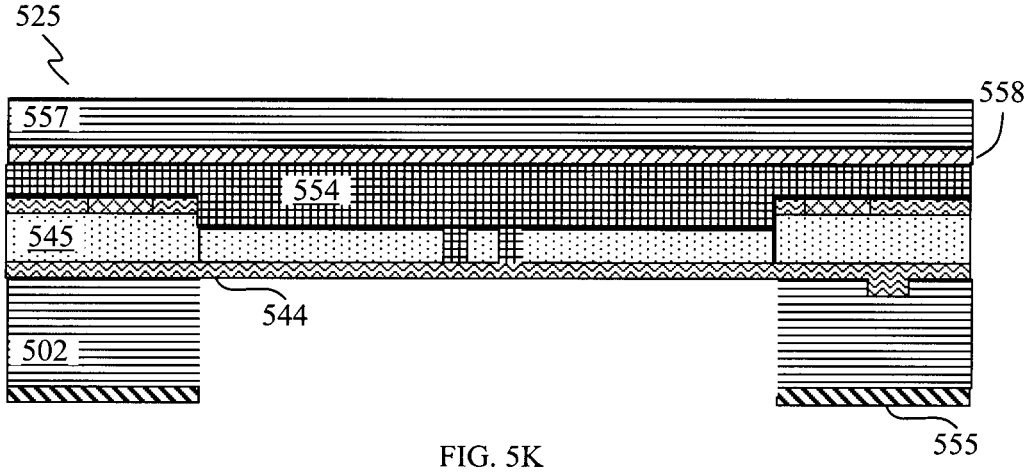

Referring to FIG. 5K, a support wafer 557 may then be bonded using a thermal tape 558 to the front side 505*a* of the substrate 502 and the structure 523. As a non-limiting example, the thermal tape 558 may have a temperature resistance of up to about 150° C. A DRIE process may then be carried out on the back side 505*b* to etch about 400 μm of the substrate 502 via the window 556, and stopping at the oxide layer 544. As a result, a structure 525 may be obtained.

Figure 5L:
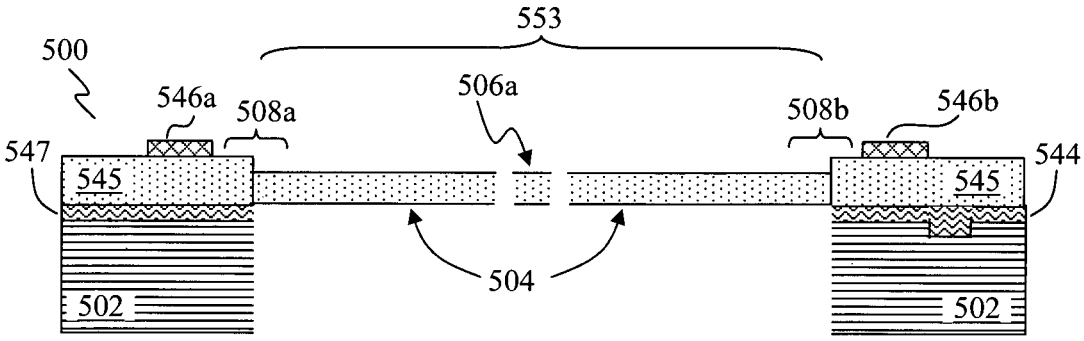

Referring to FIG. 5L, the patterned PR coating 555 may then be stripped from the structure 525. The support wafer 557 and the thermal tape 558 may be removed from the structure 525 by heating the thermal tape 558 to about 170° C. Oxygen ($O_2$) plasma treatment may be carried out to remove the negative PR coating 554. The oxide layer 547 and portions of the oxide layer 544 overlapping with the suspended structure 553 may be removed by vapour hydrogen fluoride (VHF) etching to form the final structure 500, being a microphone structure. As shown in FIG. 5L, the microphone structure 500 may have a suspended structure 553 including a suspended diaphragm 504.

Numerical simulation of the microphone of various embodiments will now be described by way of the following non-limiting examples. A simulation software or tool (e.g. based on finite element method (FEM)) may be used to simulate and analyze the microphone.

Figure 6:
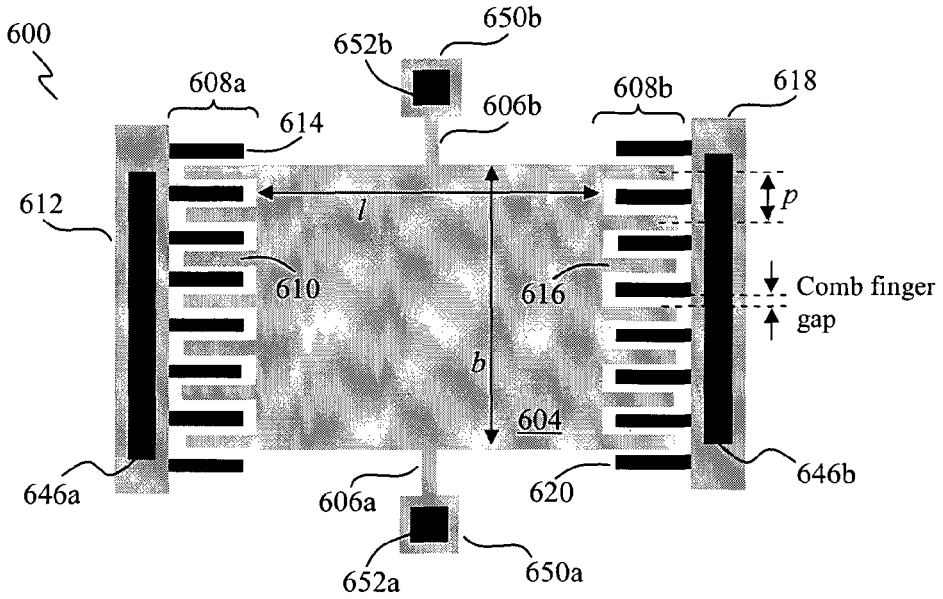
FIG. 6 shows a schematic top view of a representative layout of a microphone for simulation, according to various embodiments.

FIG. 6 shows a schematic top view of a representative layout of a microphone 600 for simulation, according to various embodiments. The microphone 600 includes a suspended diaphragm 604 with centrally coupled springs 606*a*, 606*b* and vertical comb structures 608*a*, 608*b*. The springs 606*a*, 606*b* may be coupled to anchors or supporting structures 650*a*, 650*b* respectively, with respective contact pads (e.g. metal pads) 652*a*, 652*b*. The vertical comb structure 608*a* includes electrode fingers 610 coupled to the diaphragm 604, and a fixed electrode 612 with electrode fingers 614. The electrode fingers 610 may be movable relative to the electrode fingers 614 as a result of displacement of the diaphragm 604. Similarly, the vertical comb structure 608*b* includes electrode fingers 616 coupled to the diaphragm 604, and a fixed electrode 618 with electrode fingers 620. The electrode fingers 616 may be movable relative to the electrode fingers 620 as a result of displacement of the diaphragm 604. The microphone 600 further includes contact pads (e.g. metal pads) 646*a*, 646*b* electrically coupled to the electrodes 612, 618 respectively.

Table 1 lists the design parameters used in the simulation for the microphone 600.

TABLE 1

| Design parameters | Unit | Value |
|---|---|---|
| Length of diaphragm (l) | μm | 1000 |
| Width of diaphragm (b) | μm | 1000 |
| Thickness of diaphragm (t) | μm | 2 |
| Length of comb finger (lf) | μm | 100 |
| Width of comb finger (bf) | μm | 4 |
| Thickness of fixed comb finger (tf) | μm | 3 |
| Thickness of movable comb finger (t) | μm | 2 |
| Pitch of comb finger (p) | μm | 9 |
| Comb finger gap | μm | 0.5 |
| Number of comb finger (N) | / | 100 per side |
| Length of spring (ls) | μm | 20 |
| Width of spring (bs) | μm | 2 |
| Thickness of spring (ts) | μm | 2 |
| Young's modulus (E) | GPa | 130 |
| Density (ρ) | $kg/m^3$ | 2330 |
| Bias voltage | V | 2.5 |

It should be appreciated that a combination of is =50 μm and bs=4 μm may also be used.

Figure 7:
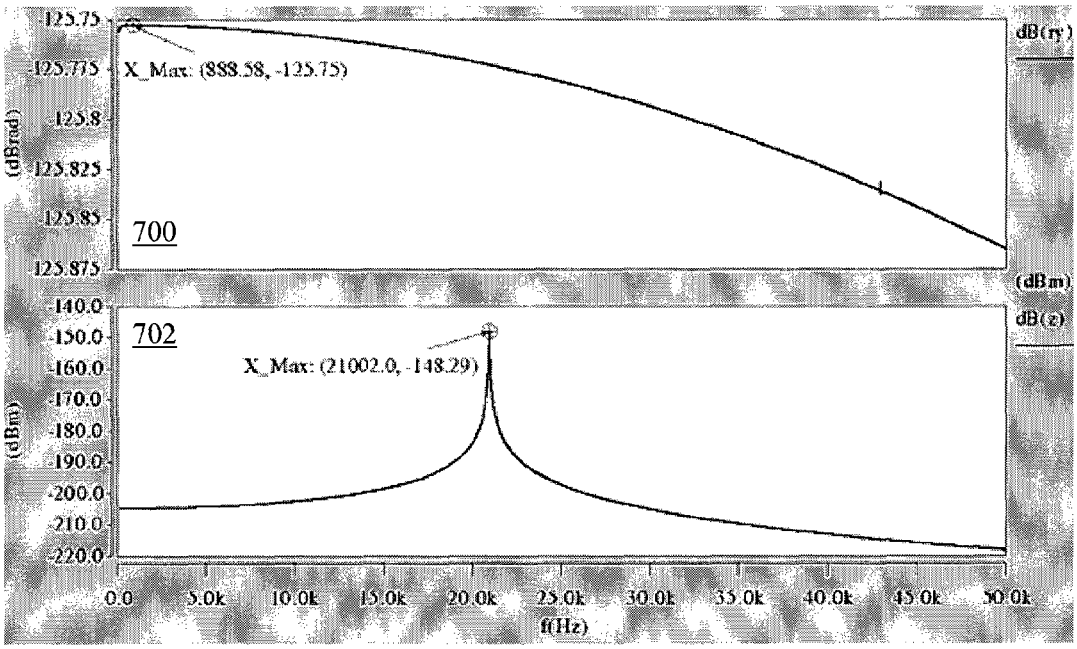
FIG. 7 shows respective plots of frequency responses of the microphone of the embodiment of FIG. 6 in directional and Omni modes, with ambient air damping.

FIG. 7 shows a plot 700 of frequency response of the microphone 600 with ambient air damping in the directional mode, and a plot 702 of frequency response of the microphone 600 with ambient air damping in the Omni mode.

Plot 700 shows that the resonant frequency of the directional mode is about 900 Hz, while plot 702 shows that the resonant frequency of the Omni mode is about 21 kHz, which is much larger than that of the directional mode. As the Omni mode is used for sensing a sound signal, a large resonant frequency is desired so as to achieve a flat frequency response curve with a large frequency range. However, there is a trade-off as a large resonant frequency may mean low sensitivity. Considering, that the frequency of sound generated by human and musical instruments, etc. is lower than about 15 kHz, the resonant frequency of the Omni mode should be larger than about 15 kHz so as to avoid or minimise acoustic resonance and distortion. As the directional mode is used for judging the direction of an input sound signal, a high sensitivity is desired in this mode, and therefore a low resonant frequency may be sufficient.

Figure 8A:
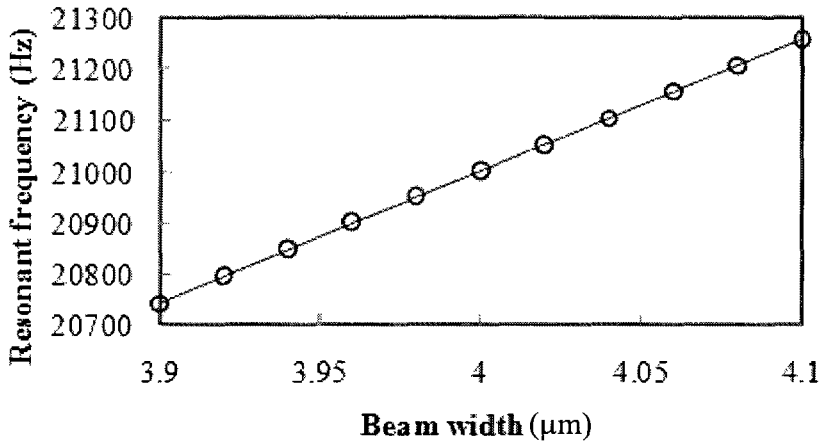
FIG. 8A shows a plot of process-induced variation in the resonant frequency of a diaphragm of a microphone in an Omni mode.

FIG. 8A shows a plot 800 of process-induced variation in the resonant frequency of a diaphragm of a microphone in an Omni mode, illustrating a change in the resonant frequency as a function of the beam width. The term "beam" refers to the springs, e.g. 606*a*, 606*b* of FIG. 6. As may be observed, the resonant frequency increases as the width of the beam increases.

Figure 8B:
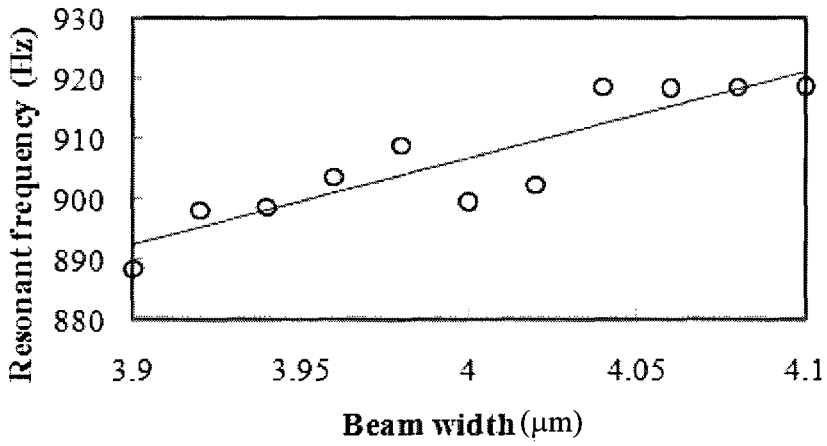
FIG. 8B shows a plot of process-induced variation in the resonant frequency of a diaphragm of a microphone in a directional mode.

FIG. 8B shows a plot of process-induced variation in the resonant frequency of a diaphragm of a microphone in a directional mode, illustrating a change in the resonant frequency as a function of the beam width. The term "beam" refers to the springs, e.g. 606*a*, 606*b* of FIG. 6. As may be observed, the resonant frequency increases as the width of the beam increases.

Figure 9A:
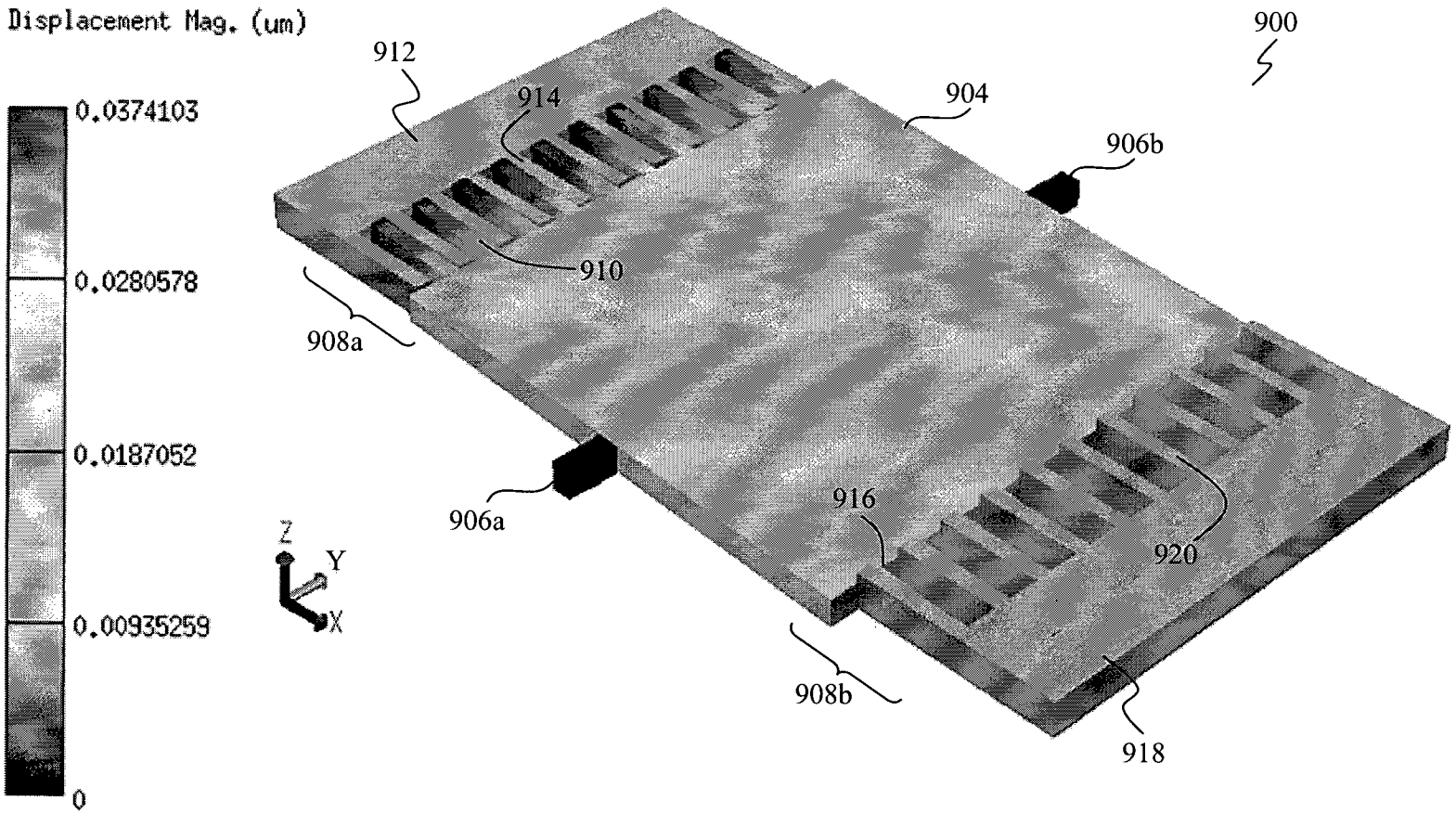
FIGS. 9A and 9B show plots of displacements of a diaphragm of a microphone in a directional mode and an Omni mode respectively.
Figure 9B:
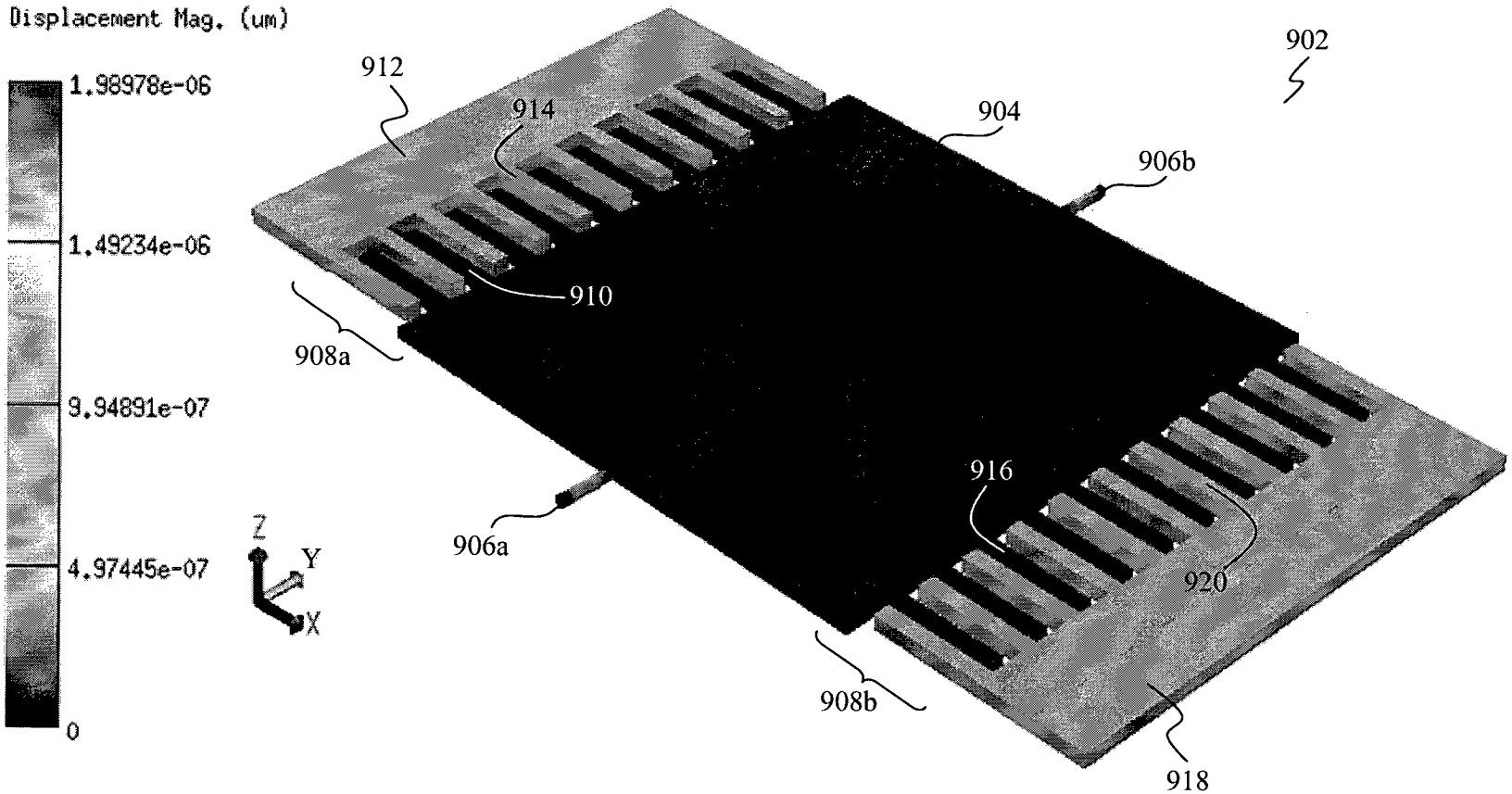

FIG. 9A shows a plot 900 of displacement of a diaphragm 904 of a microphone in a directional mode (or judging mode), while FIG. 9B shows a plot 902 of displacement of the diaphragm 904 in an Omni mode (or sensing mode). As illustrated in FIGS. 9A and 9B, springs 906*a*, 906*b* are centrally coupled to the diaphragm 904 to enable displacement of the diaphragm 904, and vertical comb structures 908*a*, 908*b* are arranged towards opposite end regions of the diaphragm 904.

As shown in plot 900 for the directional mode, for the vertical comb structure 908*a*, the fingers 910 coupled to the diaphragm 904 may be displaced upwardly relative to the fingers 914 of the fixed electrode 912 as a result of the displacement of the diaphragm 904, while for the vertical comb structure 908*b*, the fingers 916 coupled to the diaphragm 904 may be displaced downwardly relative to the fingers 920 of the fixed electrode 918 as a result of the displacement of the diaphragm 904. However, it should be appreciated that the respective displacements of the fingers 910, 916 may be reversed depending on the displacement of the diaphragm in response to an acoustic signal impinging on the diaphragm 904.

As shown in plot 902 for the Omni mode, the diaphragm 904 may be displaced upwardly such that the fingers 910 may be displaced upwardly relative to the fingers 914 and the fingers 916 may be displaced upwardly relative to the fingers 920. However, it should be appreciated that when sensing the acoustic signal impinging on the diaphragm 904, the diaphragm may additionally or alternatively be displaced downwardly. In various embodiments, the diaphragm 904 may be displaced in a combination of upwardly and downwardly motions in response to the acoustic signal impinging on the diaphragm 904 when sensing the acoustic signal in the Omni mode.

Table 2 lists a summary of the simulation results.

TABLE 2

| Key index | Omni mode | Directional mode |
|---|---|---|
| SNR (signal-to-noise ratio) | 81 dB (high) | 30 dB (low) |
| Sensitivity | −31.4 dB (high) | −67.7 dB (low) |
| Initial capacitance | 2.7 pF | 2.7 pF |
| Capacitance sensitivity | 5.8 fF/Pa | 60 aF/Pa |
| Resonant frequency | 21.1 kHz | 1.1 kHz |
| 5% CD loss induced variation | 1.23% | 2.12% |
| Directivity | No | Yes (limited angle) |

The parameter "5% CD (critical dimension) loss induced variation" may refer to a variation caused by fabrication. For example, if the designed spring width is about 5 μm, the fabricated spring width may be within 5 μm±0.25 μm; where this CD loss (design parameter drift due to fabrication) may cause the resonant frequency of the microphone to drift.

In various embodiments, the SNRs of the dual mode microphone may be about 81 dB and about 31 dB, respectively in the Omni mode and the directional mode. The sensitivities may be about −31 dB and about −67.7 dB, respectively in the Omni mode and the directional mode, while the corresponding capacitance sensitivities may be about 5.8 fF/Pa and about 60 aF/Pa, respectively in the Omni mode and the directional mode.

Various embodiments may provide a dual mode MEMS microphone, where its working model may be as described above. The dual mode MEMS microphone may include a middle or centrally supported diaphragm, and one or more vertical comb structures. The vertical comb structure(s) may be used to realize the dual mode working of the MEMS microphone. The middle suspended diaphragm structure may have two fundamental vibration modes: the rocking mode and the motion mode (e.g. along the z-axis as described in the context of FIG. 2A), where the respective resonant frequencies may be less than about 3 kHz and more than about 15 kHz. The rocking mode of the diaphragm may be related to the directional mode of the microphone, and may be used to localize the direction of the input sound signals incident on the diaphgram and therefore also on the microphone. The motion mode of the diaphragm may be related to the Omni mode of the microphone, and may be used to sense the accepted sound signals. The microphone may be without a back plate that is present in conventional microphones. The back plate free design of the microphone may directly avoid the stiction issue associated with conventional microphones, simplify the process, improve the process yield, and lower the cost of the microphone. Simulation results as described above show that the microphone of various embodiments has good directivity pattern in the judging mode and good SNR (signal-to-noise ratio) and sensitivity performance in the sensing mode. Various embodiments further provide a process flow for fabrication of the microphone. The microphone of various embodiments may have a wide application prospect in consumer electronics including but not limited to cell phones, personal computers (PCs), laptops, cameras, etc, in the huge microphone market.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A transducer, comprising:

a substrate; and a diaphragm suspended from the substrate, wherein the diaphragm is displaceable in response to an acoustic signal impinging on the diaphragm, wherein the transducer is configured, in a first mode of operation, to determine a direction of the acoustic signal based on a first displacement of the diaphragm in the first mode of operation, and to decide to accept or reject the acoustic signal based on at least one predetermined parameter and the determined direction of the acoustic signal, wherein the at least one predetermined parameter comprises a directivity pattern of the transducer and a predetermined angle of incidence threshold value for the acoustic signal, and in a second mode of operation, to sense the acoustic signal based on a second displacement of the diaphragm in the second mode of operation if the acoustic signal is accepted in the first mode of operation, thereby retrieving encoded information in the acoustic signal.

2. The transducer as claimed in claim 1, wherein the first displacement of the diaphragm comprises a pivotal displacement.

3. The transducer as claimed in claim 1, wherein the first displacement of the diaphragm and the second displacement of the diaphragm are different motions.

4. The transducer as claimed in claim 1, wherein in the first mode of operation, the diaphragm has a resonant frequency of about 5 kHz or less.

5. The transducer as claimed in claim 1, wherein in the second mode of operation, the diaphragm has a resonant frequency of about 10 kHz or more.

6. The transducer as claimed in claim 1, further comprising at least one sensing element configured to determine the first displacement and the second displacement of the diaphragm.

7. The transducer sensor as claimed in claim 6, wherein the at least one sensing element comprises a pair of electrodes movable relative to each other.

8. The transducer as claimed in claim 7, wherein an electrode of the pair of electrodes is connected to the diaphragm.

9. The transducer as claimed in claim 8, wherein each electrode of the pair of electrodes comprises a plurality of fingers, and wherein a height of each finger of the electrode connected to the diaphragm is less than a height of each finger of the other electrode of the pair of electrodes.

10. The transducer as claimed in claim 7, wherein each electrode of the pair of electrodes comprises a plurality of fingers.

11. The transducer as claimed in claim 10, wherein the pair of electrodes is arranged in an interdigitated pattern.

12. The transducer as claimed in claim 6, comprising:

at least one first sensing element arranged on a first side of the diaphragm; and at least one second sensing element arranged on a second side of the diaphragm opposite to the first side.

13. The transducer as claimed in claim 1, further comprising at least one resilient element coupled to the diaphragm for suspending the diaphragm from the substrate.

14. The transducer as claimed in claim 1, further comprising a processing circuit configured to perform at least one of determining the direction of the acoustic signal, deciding to accept or reject the acoustic signal, or sensing the acoustic signal.

15. The transducer as claimed in claim 14, wherein the processing circuit comprises a comparator configured to receive at least one of two orthogonal components derived from the acoustic signal, the comparator further configured to compare a magnitude of a component of the two orthogonal components or a ratio of magnitudes of the two orthogonal components against the at least one predetermined parameter so as to decide to accept or reject the acoustic signal.

16. A method of controlling a transducer, the method comprising:

receiving an acoustic signal impinging on a diaphragm of a transducer, the diaphragm being suspended from a substrate of the transducer and being displaceable in response to the acoustic signal;

determining a direction of the acoustic signal based on a first displacement of the diaphragm in a first mode of operation of the transducer;

deciding to accept or reject the acoustic signal based on at least one predetermined parameter and the determined direction of the acoustic signal, wherein the at least one predetermined parameter comprises a directivity pattern of the transducer and a predetermined angle of incidence threshold value for the acoustic signal; and sensing the acoustic signal based on a second displacement of the diaphragm in a second mode of operation of the transducer if the acoustic signal is accepted to retrieve encoded information in the acoustic signal.

17. The method as claimed in claim 16, wherein deciding to accept or reject the acoustic signal comprises:

deriving two orthogonal components from the acoustic signal; and comparing a magnitude of a component of the two orthogonal components or a ratio of magnitudes of the two orthogonal components against the at least one predetermined parameter so as to decide to accept or reject the acoustic signal.

18. The method as claimed in claim 16, wherein the first displacement of the diaphragm comprises a pivotal displacement.

* * * * *